US006571668B2

(12) United States Patent
Parrick

(10) Patent No.: US 6,571,668 B2
(45) Date of Patent: Jun. 3, 2003

(54) EXTENDIBLE AND RETRACTABLE TOOL FOR APPLYING TORQUE TO WHEEL LUG NUTS

(75) Inventor: Stephen F Parrick, Newmarket (CA)

(73) Assignee: Ventra Group, Inc., Bradford (CA)

( * ) Notice: Subject to any disclaimer, the term of this patent is extended or adjusted under 35 U.S.C. 154(b) by 0 days.

(21) Appl. No.: 09/854,720

(22) Filed: May 15, 2001

(65) Prior Publication Data

US 2002/0005094 A1 Jan. 17, 2002

Related U.S. Application Data

(60) Provisional application No. 60/204,130, filed on May 15, 2000.

(51) Int. Cl.[7] ..... B25G 1/04

(52) U.S. Cl. ..... 81/177.2; 81/177.1; 81/177.85

(58) Field of Search ..... 81/177.2, 177.1, 81/177.4, 177.8, 177.85

(56) References Cited

U.S. PATENT DOCUMENTS

| | | | | |
|---|---|---|---|---|
| 1,417,683 A | | 5/1922 | Parsons | |
| 2,438,633 A | * | 3/1948 | Condor | 81/177.2 |
| 2,520,652 A | * | 8/1950 | Pfauser et al. | 81/177.2 |
| 2,549,910 A | | 4/1951 | Lane | |
| 2,964,981 A | | 12/1960 | Blunt | |
| 4,070,932 A | * | 1/1978 | Jeannotte | 81/177.2 |
| 4,300,412 A | | 11/1981 | Houser et al. | |
| 4,376,397 A | * | 3/1983 | Newby et al. | 81/177.2 |
| 4,691,599 A | | 9/1987 | Schultz | |
| 4,733,583 A | | 3/1988 | Lewis | |
| 4,765,009 A | * | 8/1988 | Hung | 29/245 |
| 5,109,737 A | * | 5/1992 | Raber | 81/177.2 |
| 5,201,257 A | | 4/1993 | Engel | |
| 5,218,730 A | | 6/1993 | Berry | |
| 5,363,727 A | | 11/1994 | Barth et al. | |
| 5,392,673 A | * | 2/1995 | Scott | 81/177.2 |
| 5,396,820 A | | 3/1995 | Baker | |
| 6,006,634 A | | 12/1999 | Byers | |
| 6,058,814 A | | 5/2000 | Johnson | |

FOREIGN PATENT DOCUMENTS

| | | |
|---|---|---|
| DE | 2823464 A1 | 6/1979 |
| GB | 2 040 770 A | 9/1980 |
| GB | 2 142 268 A | 1/1985 |

* cited by examiner

*Primary Examiner*—Joseph J. Hail, III
*Assistant Examiner*—Hadi Shakeri
(74) *Attorney, Agent, or Firm*—Pillsbury Winthrop LLP

(57) ABSTRACT

The present invention relates to a tool for applying torque to turnable fasteners for fastening or removing a wheel on a motor vehicle. The tool has a first arm portion and a second arm portion movable to the first arm portion between longitudinally extended and longitudinally retracted positions.

18 Claims, 5 Drawing Sheets

EXTENDIBLE AND RETRACTABLE TOOL FOR APPLYING TORQUE TO WHEEL LUG NUTS

The present application claims priority to U.S. Provisional Application of Parrick, Serial No. 60/204,130, May 15, 2000 the entirety of which is hereby incorporated into the present application by reference.

BACKGROUND OF THE INVENTION

1. Field of the Invention

The present invention relates to a tool for applying torque to lug nuts on the wheel of a motor vehicle.

2. Description of Related Art

It is desirable to provide a lug wrench with motor vehicles for use by the operator. Traditionally, cross-type lug wrenches have been used, which provide two handles for applying torque. This configuration makes it possible for most users to apply sufficient torque for tightening wheel lug nuts. However, cross-type lug wrenches require a large storage space inside the vehicle.

It is known from U.S. Pat. No. 5,201,257 to Engel to provide a tool for applying torque to wheel lug nuts wherein the tool comprises two arm portions that are pivotable relative to one another about a hinge pin between (1) a folded position for compact storage within the motor vehicle an (2) an extended position for increased leverage during application of torque to the wheel lug nuts. The use of the hinge pin is undesirable because the pin itself is an added cost and is difficult to handle and properly install between the two wrench arms during assembly.

It is also known from U.S. Pat. No. 5,218,730 to Berry to provide a tool for removing and replacing lug nuts that includes a collapsible inner and outer tube. In the Berry patent a spring loaded detent plug is provided to restrict the inner tube from coming out of the outer tube in several telescoping positions. The use of a spring loaded plug is undesirable because the plug, the spring, and the associated holes are added costs for manufacturing, and make the tool more difficult to use.

There is a need for a lug wrench which can be stored in a small space in a motor vehicle that is inexpensive to make, easy to use, and will enable most users to be able to create sufficient torque to tighten lug nuts on a motor vehicle.

SUMMARY OF THE INVENTION

It is an object of the invention to meet the above-described need. To meet this need one aspect of the present invention provides a tool for applying torque to turnable fasteners for fastening or removing a wheel on a motor vehicle. The tool includes a first arm portion having a fastener coupling structure constructed and arranged to be removably coupled to a fastener for turning the fastener about a turning axis through the center of the fastener. The first arm portion extends on a longitudinal axis in a transverse direction with respect to the turning axis. Thus torque can be applied to the fastener to affect turning thereof in either direction about the turning axis via the fastener coupling structure. The torque can be applied by applying a force generally circumferential to the turning axis to the first arm portion in longitudinally spaced relation to the turning axis when the fastener coupling structure is removably coupled to the fastener.

The tool also includes a second arm portion capable of applying an increased torque to the turnable fastener via the first arm portion. The increased torque can be applied by manually applying a force generally circumferential to the turning axis to the second arm portion in longitudinally spaced relation to the turning axis when the second arm portion is in a longitudinally extended position with respect to the first arm portion.

The tool further includes cooperating structure on the first arm portion and the second arm portion constructed and disposed to (1) allow the second arm portion to be rotated about the longitudinal axis with respect to the first arm portion between an interlocked longitudinally extended position and a released longitudinally extended position, (2) allow the second arm portion to be extended or retracted generally longitudinally with respect to the first arm portion between the released longitudinally extended position and a longitudinally retracted position, and (3) prevent the second arm portion from retracting generally longitudinally when the second arm portion is in the interlocked longitudinally extended position. In the longitudinally retracted position, the tool is of a length suitable for storage.

Another aspect of the current invention provides a method for applying torque to turnable fasteners for fastening or removing a wheel on a motor vehicle. The method includes providing a tool having a first arm portion with a fastener coupling structure which may be removably coupled with a turnable fastener. The first arm portion extends on a longitudinal axis in a transverse direction with respect to a turning axis through the center of the turnable fastener. The tool also has second arm portion mounted to the first arm portion for longitudinal relative movement with respect to said first arm portion.

The method also includes removing the tool from a storage location within the motor vehicle, the tool being in a longitudinally retracted position suitable for storage. The second arm portion is then extended generally longitudinally with respect to the first arm portion to a released longitudinally extended position. The second arm portion is then rotated about the longitudinal axis with respect to the first arm portion to an interlocked longitudinally extended position. The fastener coupling structure is then coupled to the turnable fastener. A force generally circumferential to the turning axis is then manually applied to the second arm portion in longitudinally spaced relation to the turning axis to apply via the first arm portion a torque to affect turning of the turnable fastener. The previous step is repeated on a plurality of fasteners until the wheel is fully fastened to the motor vehicle or fully removed from the motor vehicle. The second arm portion is then rotated about the longitudinal axis with respect to the first arm portion thereby returning the second arm portion to the released longitudinally extended position. The second arm portion is then retracted generally longitudinally with respect to the first arm portion thereby returning the second arm portion to the longitudinally retracted position so that the tool is of a length suitable for storage in the storage location, and the tool is returned to the storage location within the motor vehicle.

Other objects, features, and advantages of the present invention will become apparent from the following description, the accompanying drawings and the appended claims.

DETAILED DESCRIPTION OF A PREFERRED EMBODIMENT OF THE INVENTION

Figure 1:
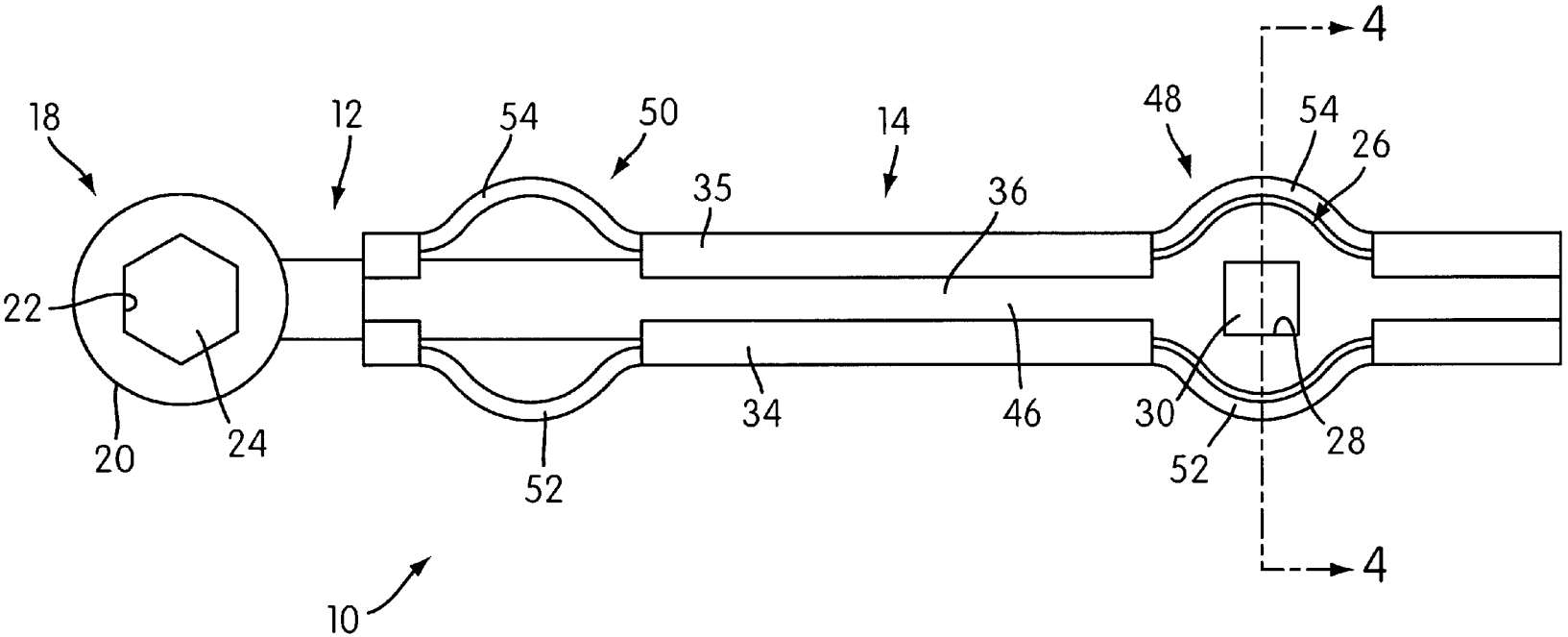
FIG. 1 is a top plan view of a telescoping tool constructed in accordance with the principles of the present invention, the first and second arm portions of the tool being disposed in an interlocked longitudinally retracted position with respect to one another.

FIG. 1 shows a tool, generally indicated at 10, for applying torque to turnable fasteners for fastening a wheel to a motor vehicle. The fasteners and wheel are not shown, but are understood to be of any type known in the art. Typically, the fasteners will be hexagonal lug nuts that thread onto threaded posts extending from the wheel hub through apertures in the wheel rim to secure the wheel to the wheel hub. The tool 10 comprises an elongated forged first arm portion 12 and an elongated stamped second arm portion 14.

A fastener coupling structure 18 is provided on one end of the first arm portion 12. The fastener coupling structure is constructed and arranged to be removably coupled with a wheel fastener such that torque applied to the coupling structure 18 is transmitted to the fastener to effect tightening or loosening rotation thereof about a turning axis which passes through the center of the fastener. The remainder of the first arm portion extends on a longitudinal axis in a transverse direction with respect to the turning axis. Torque can be applied to the fastener to affect rotation thereof via the fastener coupling structure 18 by applying manual force generally circumferential to the turning axis to the first arm portion 12 when the fastener coupling structure is removably coupled to the fastener. The fastener coupling structure 18 illustrated is in the form of an integrally formed socket 20 with interior flat surfaces 22 defining a hexagonally shaped fastener receiving opening 24. However, the fastener coupling structure 18 may have any suitable construction or arrangement and the invention is not intended to be limited to the construction illustrated.

The first portion 12 also has a jack tool coupling portion 26 with a plurality of flat surfaces 28 defining a jack tool receiving opening 30. This opening 30 allows the tool 10 to be used for applying torque to a jack tool (not shown) which is coupled with the torque receiving input of a vehicle jack (not shown). Specifically, the user slides the opening 30 over the complementarily shaped free end of the jack tool (or a series of jack tools coupled together) and rotates the tool 10 to apply torque to the jack tool. Depending on the specific type of jack tool used, the first and second arm portions 12, 14 may be moved to their extended positions as will be explained herein below, thereby providing two hand placement locations for applying torque to the jack tool. The provision of the jack tool coupling portion 26 is not considered a critical part of the invention, but is preferred to make tool 10 multi-functional.

Figure 2:
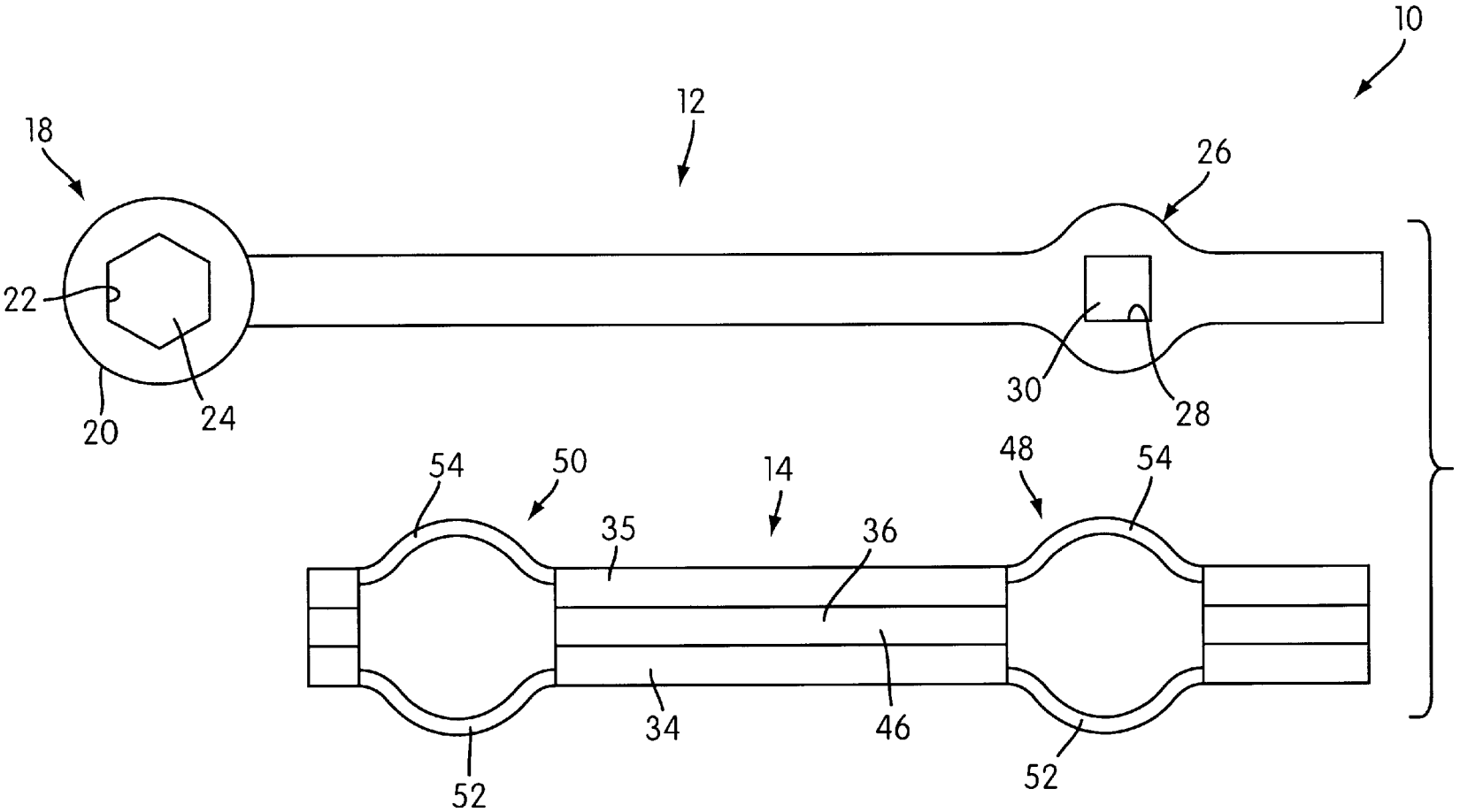
FIG. 2 is a top plan view similar to FIG. 1 with the first and second arm portions separated from one another.
Figure 3:
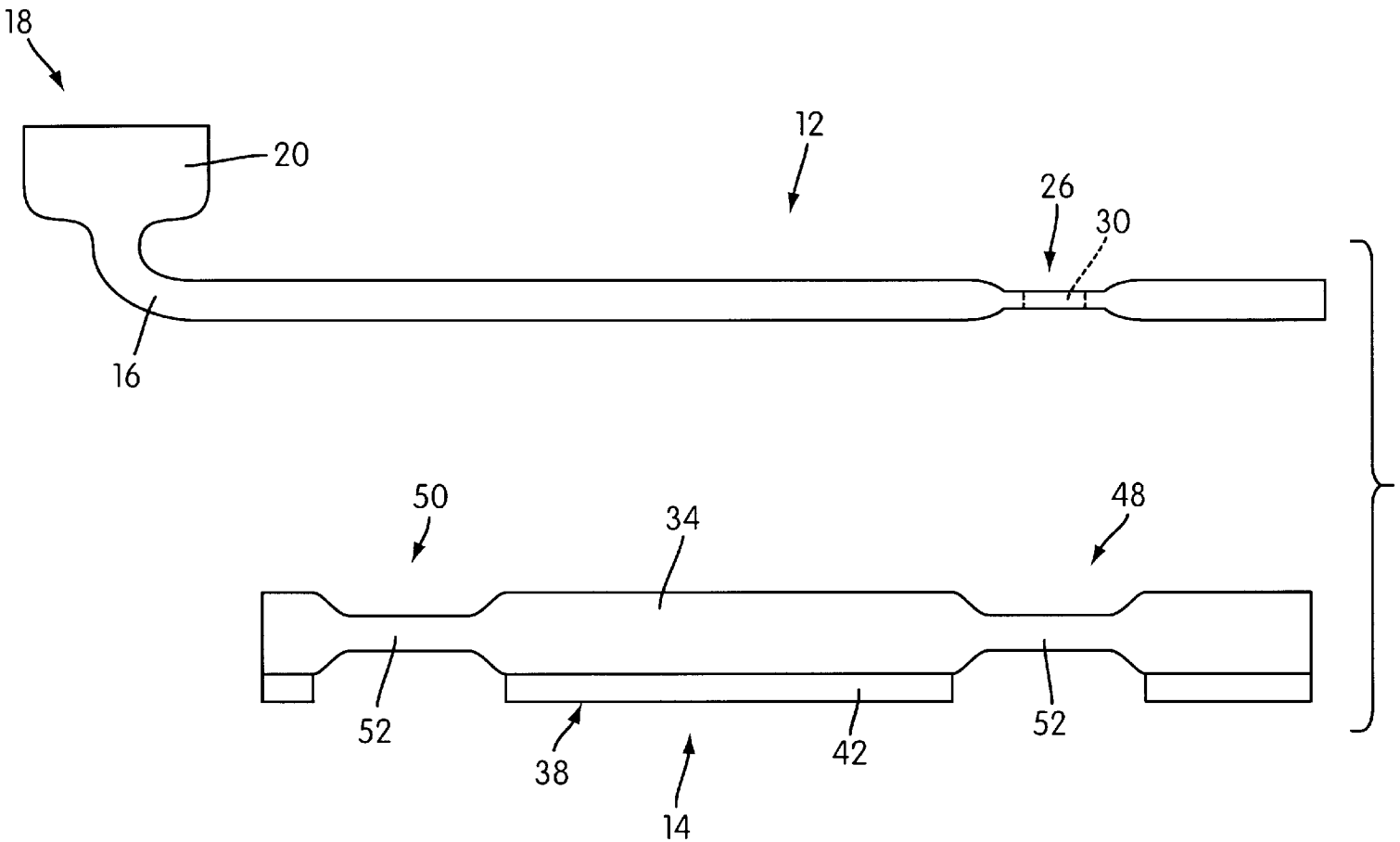
FIG. 3 is an elevated side, view of the first and second arm portions separated from one another.

As can be seen from the views of FIGS. 2 and 3, the jack tool coupling portion 26 has a greater width and a lesser thickness than the remainder of the main portion of the first arm portion 12.

The second arm portion 14 has an elongated, partially tubular shape that is stamped in a progressive manner from a flat piece of metal. The second arm portion 14 has a pair of arcuate walls 34, 35 that have free ends spaced apart from one another to define a gap 36 therebetween. The arcuate walls 34, 35 are integrally formed with a groove defining portion 38, which comprises two generally parallel walls 40, 42 and a bottom wall 44 joined to the parallel walls 40, 42 to define an elongated groove 46. The second arm portion 14 has two wide diameter portions 48, 50 that are configured for receiving the wide jack coupling portion 26. These wide diameter portions 48, 50 have curved walls 52, 54 that extend between adjacent interrupted portions of the arcuate walls 34, 35. The groove defining portion 38 is also interrupted at this point.

Figure 4:
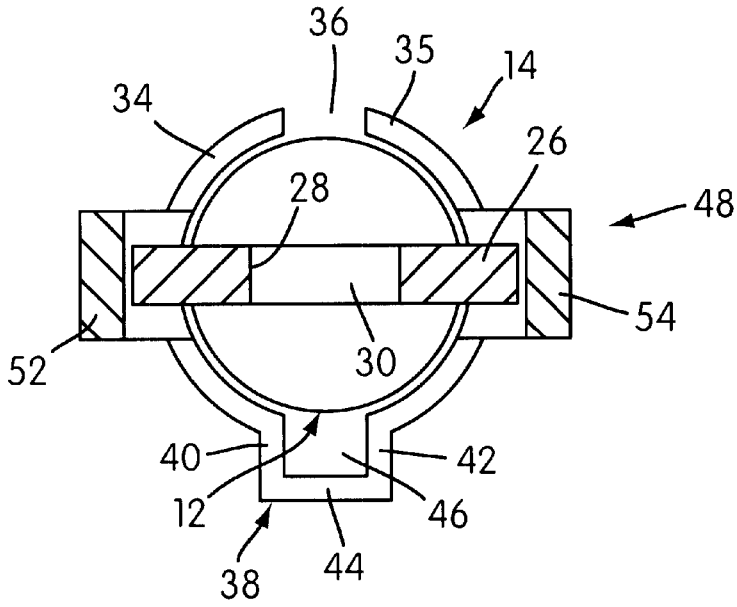
FIG. 4 is a cross-sectional view taken along line 4—4 of FIG. 1 with the first and second arm portions being disposed in a releasably interlocked position thereof to prevent relative longitudinal movement thereof.

FIGS. 1 and 4 show the first and second arm portions 12, 14 in the interlocked longitudinally retracted position thereof for compact storage in the motor vehicle. As can be appreciated from all the Figures, the first arm portion 12 is received within the second arm portion 14 in a telescoping manner. Normally when the first and second arm portions 12, 14 are in the longitudinally retracted position thereof, the first and second arm portions 12, 14 are rotated relative to one another to a releasably interlocked position wherein the first and second arm portions 12, 14 are prevented from moving generally longitudinally relative to one another. FIG. 4 best illustrates the releasably interlocked position. As can be seen in FIG. 4, in the interlocked position, the first arm portion 12 is rotated so that the width direction of the jack coupling portion is oriented generally perpendicularly to the gap 36 and the groove 46. As a result of this orientation, the jack coupling portion 26 will abut against the curved walls 52, 54 to prevent generally longitudinal relative movement between the first arm portion 12 and the second arm portion 14.

Figure 5:
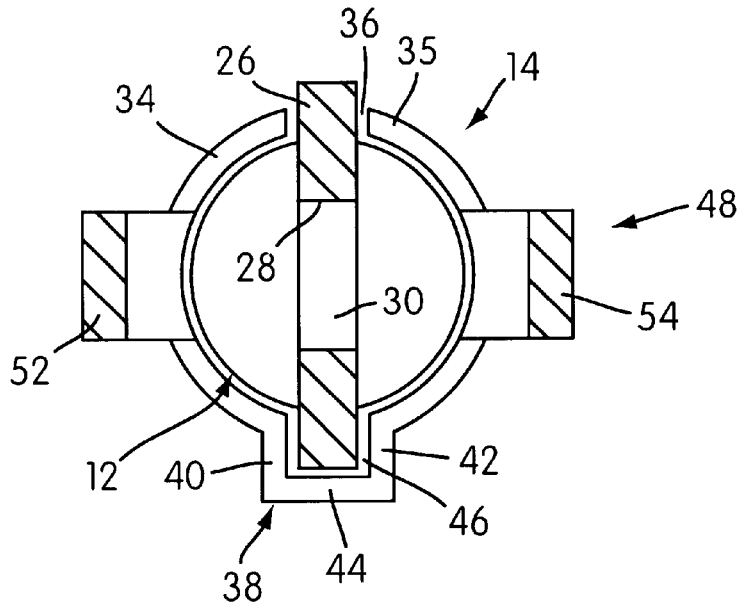
FIG. 5 is a cross-sectional view similar to FIG. 4 with the first and second arm portions being rotated to a released position to allow for relative longitudinal movement thereof.
Figure 6:
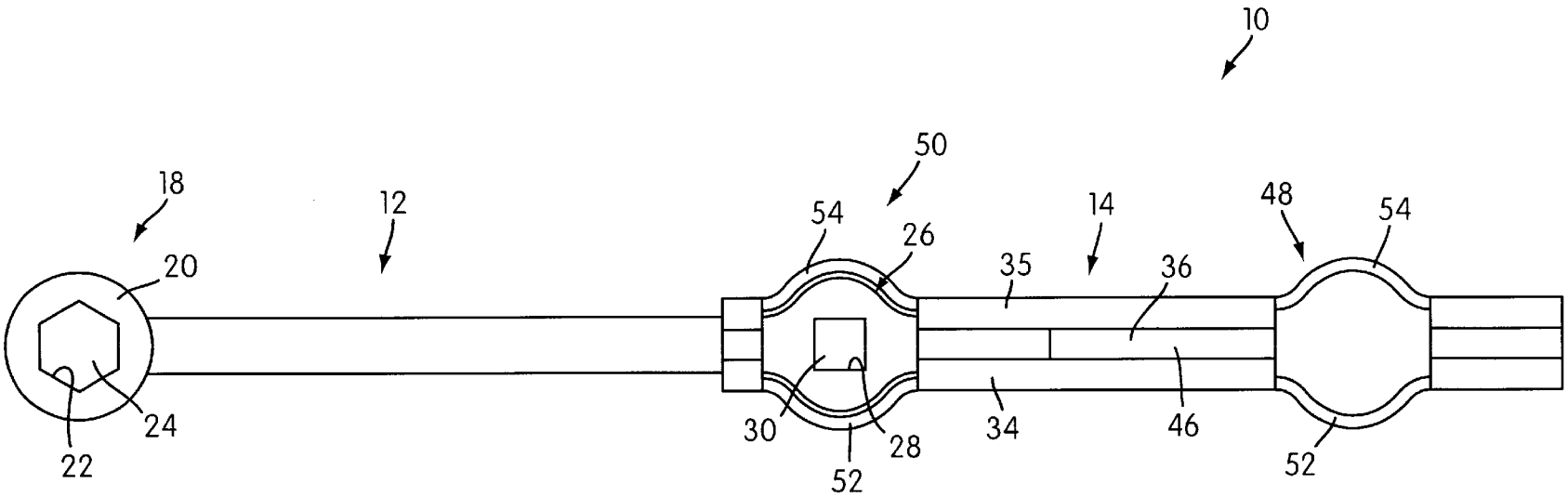
FIG. 6 is a top plan view similar to FIG. 1 with the first and second arm portions being moved to the interlocked longitudinally extended position thereof.

To move the first and second arm portions 12, 14 generally longitudinally relative to one another to an extended position, the first and second arm portions 12, 14 are rotated relative to one another for about 90 degrees so that the wide diameter jack coupling portion 26 is aligned with the gap 36 and the groove 46, as shown in FIG. 5. This is considered a released position. In this released position, the first and second arm portions 12, 14 can be moved generally longitudinally relative to one another to their extended position as shown in FIG. 6 and rotated back about 90 degrees so that the jack coupling portion 26 is positioned in the above described releasably interlocked position within wide diameter portion 50. This releasably interlocks the first and second arm portions 12, 14 in the extended position.

In the interlocked longitudinally extended position of the first and second arm portions 12, 14, the user has increased leverage for applying torque to the wheel fastener. Specifically, the user can apply manual force generally circumferential to the turning axis in longitudinally spaced relation to the turning axis to the second arm portion 14, which force is transmitted through the first arm portion and applied as torque to the fastener via the fastener coupling structure 18.

In order to use the tool to apply torque to turnable fasteners for fastening or removing a wheel on a motor vehicle the operator would first remove the tool from a storage location within the motor vehicle such as in the trunk or some other secure place. The tool would be compactly stored in a longitudinally retracted position, preferably in the interlocked longitudinally retracted position. Then, if the tool is in an interlocked position, the operator would rotate the second arm portion about the longitudinal axis with respect to the first arm portion to the released longitudinally retracted position. Then the operator extends the second arm portion generally longitudinally with respect to the first arm portion to the released longitudinally extended position. Then the operator rotates the second arm portion about the longitudinal axis with respect to the first arm portion to the interlocked longitudinally extended position. The operator then couples the fastener coupling structure to one of the fasteners and applies a manual force generally circumferential to the turning axis to the second arm portion in longitudinally spaced relation to the turning axis. This would be repeated until all fasteners are either fully tightened or removed. Then the operator rotates the second arm portion back to the released longitudinally extended position, moves the second arm portion generally longitudinally back to the released longitudinally retracted position, and rotates the second arm portion back to the interlocked longitudinally retracted position. Finally, the user replaces the tool in the storage location within the vehicle.

It will thus be seen that the objects of the invention have been fully and effectively accomplished. The foregoing illustrated embodiment has been provided to illustrate the structural and functional principles of the present invention and is not intended to be limiting. To the contrary, the present invention is intended to encompass all modifications, alterations, substitutions and equivalents within the spirit and scope of the following claims.

What is claimed is:

1. A tool for applying torque to turnable fasteners for fastening or removing a wheel on a motor vehicle, said tool comprising:

a first arm portion having a fastener coupling structure constructed and arranged to be removably coupled to a fastener for turning said fastener about a turning axis through a center of said fastener, said first arm portion extending on a longitudinal axis in a transverse direction with respect to said turning axis such that torque can be applied to said turnable fastener to affect turning thereof in either direction about said turning axis via said fastener coupling structure by applying a force generally circumferential to said turning axis to said first arm portion in longitudinally spaced relation to said turning axis when said fastener coupling structure is removably coupled to said fastener;

a second arm portion capable of applying an increased torque to said turnable fastener via said first arm portion by manually applying a force generally circumferential to said turning axis to said second arm portion in longitudinally spaced relation to said turning axis when said second arm portion is in a longitudinally extended position with respect to said first arm portion; and cooperating structure on said first arm portion and said second arm portion constructed and disposed to (1) allow said second arm portion to be rotated about said longitudinal axis with respect to said first arm portion between an interlocked longitudinally extended position and a released longitudinally extended position, (2) allow said second arm portion to be extended or retracted generally longitudinally with respect to said first arm portion between said released longitudinally extended position and a longitudinally retracted position, said tool being of a length suitable for storage when said second arm portion is in said longitudinally retracted position, and (3) prevent said second arm portion from retracting generally longitudinally when said second arm portion is in said interlocked longitudinally extended position;

wherein said first arm portion is received within said second arm portion, and said cooperating structure comprises a protruding portion on an outer surface of said first arm portion in cooperation with a wide diameter portion connected to a groove on an inner surface of said second arm portion such that said protruding portion may be rotated about said longitudinal axis within said wide diameter portion and may be moved generally longitudinally within said groove; and wherein said second arm portion includes a pair of arcuate walls integrally formed with said groove, said arcuate walls having free ends spaced apart from one another to define a gap therebetween, said gap being parallel to and opposite of said groove, and wherein said protruding portion on said first arm portion has a greater width and lesser thickness than the remainder of said first arm portion.

2. The tool of claim 1, said cooperating structure further allowing aid second arm portion to be rotated about said longitudinal axis with respect to said first arm portion between a released longitudinally retracted position and an interlocked longitudinally retracted position, said cooperating structure preventing said second arm portion from extending generally longitudinally when said second arm portion is in said interlocked longitudinally retracted position.

3. The tool of claim 1 wherein said protruding portion of said first arm portion includes a jack tool coupling portion with a plurality of flat surfaces defining a jack tool receiving opening which allows said tool to couple with an end of a jack tool and rotate about a jack tool axis to effect turning of said jack tool to operate a vehicle jack, such that two hand placement locations for turning may be used when said second arm portion is in said interlocked longitudinally extended position with respect to said first arm portion.

4. The tool of claim 1 wherein said groove extends to an end of said second arm portion, allowing said second arm portion to move longitudinally from either said released longitudinally extended or said longitudinally retracted position to be separated from said first arm portion.

5. A tool according to claim 1 wherein said fastener coupling structure is a socket extending on said turning axis and having a plurality of internal surfaces for engaging the fasteners.

6. A tool according to claim 5, wherein said socket is formed integrally on said first arm portion as one-piece therewith and wherein said first arm portion is bent to position said socket perpendicularly to said longitudinal axis.

7. A tool for applying torque to turnable fasteners for fastening or removing a wheel on a motor vehicle, said tool comprising:

a first arm portion having a fastener coupling structure constructed and arranged to be removably coupled to a fastener for turning said fastener about a turning axis through a center of said fastener, said first arm portion extending on a longitudinal axis in a transverse direction with respect to said turning axis such that torque can be applied to said turnable fastener to affect turning thereof in either direction about said turning axis via said fastener coupling structure by applying a force generally circumferential to said turning axis to said first arm portion in longitudinally spaced relation to said turning axis when said fastener coupling structure is removably coupled to said fastener;

a second arm portion capable of applying an increased torque to said turnable fastener via said first arm portion by manually applying a force generally circumferential to said turning axis to said second arm portion in longitudinally spaced relation to said turning axis when said second arm portion is in a longitudinally extended position with respect to said first arm portion; and cooperating structure on said first arm portion and said second arm portion constructed and disposed to (1) allow said second arm portion to be rotated about said longitudinal axis with respect to said first arm portion between an interlocked longitudinally extended position and a released longitudinally extended position, (2) allow said second arm portion to be extended or retracted generally longitudinally with respect to said first arm portion between said released longitudinally extended position and a longitudinally retracted position, said tool being of a length suitable for storage when said second arm portion is in said longitudinally retracted position, and (3) prevent said second arm portion from retracting generally longitudinally when said second arm portion is in said interlocked longitudinally extended position;

wherein said first arm portion is received within said second arm portion, and said cooperating structure comprises a protruding portion on an outer surface of said first arm portion in cooperation with a wide diameter portion connected to a groove on an inner surface of said second arm portion such that said protruding portion may be rotated about said longitudinal axis within said wide diameter portion and may be moved generally longitudinally within said groove; and wherein said protruding portion of said first arm portion includes a jack tool coupling portion with a plurality of flat surfaces defining a jack tool receiving opening which allows said tool to couple with an end of a jack tool and rotate about a jack tool axis to effect turning of said jack tool to operate a vehicle jack, such that two hand placement locations for turning may be used when said second arm portion is in said interlocked longitudinally extended position with respect to said first arm portion.

8. The tool of claim 7 wherein said second arm portion includes a pair of arcuate walls integrally formed with said groove, said arcuate walls having free ends spaced apart from one another to define a gap therebetween, said gap being parallel to and opposite of said groove, and wherein said protruding portion on said first arm portion has a greater width and lesser thickness than the remainder of said first arm portion.

9. The tool of claim 7, said cooperating structure further allowing said second arm portion to be rotated about said longitudinal axis with respect to said first arm portion between a released longitudinally retracted position and an interlocked longitudinally retracted position, said cooperating structure preventing said second arm portion from extending generally longitudinally when said second arm portion is in said interlocked longitudinally retracted position.

10. The tool of claim 7 wherein said groove extends to an end of said second arm portion, allowing said second arm portion to move longitudinally from either said released longitudinally extended or said longitudinally retracted position to be separated from said first arm portion.

11. A tool according to claim 7, wherein said fastener coupling structure is a socket extending on said turning axis and having a plurality of internal surfaces for engaging the fasteners.

12. A tool according to claim 11, wherein said socket is formed integrally on said first arm portion as one-piece therewith and wherein said first arm portion is bent to position said socket perpendicularly to said longitudinal axis.

13. A method for applying torque to tunable fasteners for fastening or removing a wheel on a motor vehicle, said method composing providing a tool having a first arm portion with a fastener coupling structure constructed and ranged to be removably coupled with a tunable fastener, said first arm portion extending on a longitudinal axis in a transverse direction with respect to a turning axis through a center of said tamable fastener, said tool also having a second arm portion mounted to said first arm portion for longitudinal relative movement with respect to said first arm portion, said first arm portion and said second arm portion include cooperating structure constructed and disposed to (1) allow said second arm portion to be rotated about said longitudinal axis with respect to said first arm portion between an interlocked longitudinally extended position and a released longitudinally extended position, (2) allow said second arm portion to be extended or refracted generally longitudinally with respect to said first arm portion between said released longitudinally extended position and a released longitudinally retracted position, (3) allow said second arm portion to be rotated about said longitudinal axis with respect to said first arm portion between said released longitudinally retracted position and an interlocked longitudinally retracted position suitable for storage, and (4) prevent said second arm portion from extending or retracting generally longitudinally when said second arm portion is in said interlocked longitudinally refracted position or in said interlocked longitudinally extended position;

removing said tool from a storage location within said motor vehicle, said second arm portion being in said interlocked longitudinally retracted position with respect to said first am portion so that said tool is of a length suitable for storage in said storage location;

rotating said second arm portion about said longitudinal axis with respect to said first arm portion from said interlocked longitudinally retracted position to said released longitudinally retracted position to thereby enable said cooperating structure to allow said second arm portion to be extended generally longitudinally with respect to said first arm portion from said released longitudinally retracted position to said released longitudinally extended position;

extending said second arm portion generally longitudinally with respect to said first arm portion from said released longitudinally retracted position to said released longitudinally extended position;

rotating said second arm portion about said longitudinal axis with respect to said first arm portion to said interlocked longitudinally extended position so as to enable said cooperating structure to prevent said second arm portion from retracting generally longutidinally;

coupling said fastener coupling structure to said turnable fastener;

manually applying a force generally circumferential to said turning axis to said second arm portion in longitudinally spaced relation to said turning axis to apply via said first arm portion a torque to affect turning of said tunable fastener;

repeating the previous step on a plurality of fasteners until said wheel is fully fastened to said motor vehicle or fully removed from said motor vehicle;

rotating said second arm portion about said longitudinal axis with respect to said first arm portion thereby returning said second arm portion to said released longitudinally extended position so as to enable said cooperating structure to allow said second arm portion to retract generally longitudinally;

retracting said second arm portion generally longitudinally with respect to said first arm portion thereby returning said second arm portion to said released longitudinally retracted position so that said tool is again of said length suitable for storage in said storage location;

rotating said second arm portion about said longitudinal axis with respect to said first arm portion from said released longitudinally retracted position to said interlocked longitudinally retracted position so as to enable said cooperating structure to prevent said second arm portion from extending generally longitudinally-, and returning said tool to said storage location within said motor vehicle;

wherein said first arm portion is received within said second arm portion, said cooperating structure comprises a protruding portion on an outer surface of said first arm portion in cooperation with two wide diameter portions connected to a groove on an inner surface of said second arm portion such that said protruding portion may be rotated about said longitudinal axis within said wide diameter portions and may be moved longitudinally within said groove, said second arm portion includes a pair of arcuate walls integrally formed with said groove, said arcuate walls have free ends spaced apart from one nether to define a gap therebetween parallel to and opposite of said groove, and wherein said protruding portion has a greater width and lesser thickness than the remainder of said first arm portion, wherein rotating said second arm portion about said longitudinal axis with respect to said first arm portion between said released and interlocked positions includes rotating said second arm portion with respect to said first arm portion when said protruding portion is within an associated one of said wide diameter portions to (a) align said protruding portion with both said groove and said gap to affect an associated released position and (b) disalign said protruding portion with said groove and said gap to affect an associated interlocked position; and wherein extending or retracting said second arm portion along said longitudinal axis with respect to said first arm portion between said released extended and released retracted positions thereof includes extending or retracting said second arm portion with respect to said first arm portion while said protruding portion is aligned with both said groove and said gap such that said protruding portion rides within said groove and said gap.

14. The method of claim 13 wherein said groove extends beyond one of said wide diameter portions to an end of said second arm portion, allowing said second arm portion to further extend or retract longitudinally from either said released longitudinally extended or said longitudinally retracted position to be separated from said first arm portion; said method further comprising:

extending or retracting said second arm portion longitudinally from either said released longitudinally extended or said longitudinally retracted position to separate said second arm portion from said first arm portion.

15. A method for applying torque to turnable fasteners for fastening or removing a wheel on a motor vehicle, said method comprising:

providing a tool having a first arm portion with a fastener coupling structure constructed and arranged to be removably coupled with a turnable fastener, said first arm portion extending on a longitudinal axis in a transverse direction with respect to a turning axis through a center of said turnable fastener, said tool also having a second arm portion mounted to said first arm portion for longitudinal relative movement with respect to said first arm portion, said first arm portion and said second arm portion include cooperating structure constructed and disposed to (1) allow said second arm portion to be rotated about said longitudinal axis with respect to said first arm portion between an interlocked longitudinally extended position and a released longitudinally extended position, (2) allow said second arm portion to be extended or retracted generally longitudinally with respect to said first arm portion between said released longitudinally extended position and a released longitudinally refracted position, and (3) allow said second arm portion to be rotated about said longitudinal axis with respect to said first arm portion between said released longitudinally refracted position and an interlocked longitudinally retracted position suitable for storage, and (4) prevent said second arm portion from extending or retracting generally longitudinally when said second arm portion is in said interlocked longitudinally retracted position or in said interlocked longitudinally extended position;

removing said tool from a storage location within said motor vehicle, said second arm portion being in said interlocked longitudinally retracted position wit respect to said first arm portion so that said tool is of a length suitable for storage in said storage location;

rotating said second arm portion about said longitudinal axis with respect to said first arm portion from said interlocked longitudinally retracted position to said released longitudinally retracted position to thereby enable said cooperating structure to allow said second arm portion to be extended generally longitudinally with respect to said first arm portion from said released longitudinally retracted position to said released longitudinally extended position;

extending said second arm portion generally longitudinally with respect to said first arm portion from said released longitudinally retracted position to said released longitudinally extended position;

rotating said second arm portion about said longitudinal axis with respect to said first arm portion to said interlocked longitudinally extended position so as to enable said cooperating structure to prevent said second arm portion from retracting generally longitudinally;

coupling said fastener coupling structure to said turnable fastener;

manually applying a force generally circumferential to said turning axis to said second arm portion in longitudinally spaced relation to said turning axis to apply via said first arm portion a torque to affect turning of said turnable fastener;

repeating the previous step on a plurality of fasteners until said wheel is fully fastened to said motor vehicle or fully removed from said motor vehicle;

rotating said second arm portion about said longitudinal axis with respect to said first arm portion thereby returning said second arm portion to said released longitudinally extended position so as to enable said cooperating structure to allow said second arm portion to retract generally longitudinally;

retracting said second arm portion generally longitudinally with respect to said lint arm portion thereby returning said second arm portion to said released longitudinally retracted position so that said tool is again of said length suitable fur storage in said storage location;

rotating said second arm portion about said longitudinal axis with respect to said first arm portion from said released longitudinally retracted position to said interlocked longitudinally retracted position so as to enable said cooperating structure to prevent said second arm portion from extending generally longitudinally;

and returning said tool to said storage location within said motor vehicle;

wherein said first arm portion is received within said second arm portion, and said cooperating structure comprises a protruding portion on an outer surface of said first arm portion in cooperation with two wide diameter portions connected to a groove on an inner surface of said second arm portion such that said protruding portion may be rotated about said longitudinal axis within said wide diameter potions and may be moved longitudinally within said groove, wherein rotating said second arm portion about said longitudinal axis with respect to said first arm portion between said released and interlocked positions includes rotating said second arm portion with respect to said first arm portion when said protruding portion is within an associated one of said wide diameter portions to (a) align said protruding portion with said groove to affect an associated released position and (b) disalign said protruding portion with said groove to affect an associated interlocked position; and wherein extending or retracting said second arm portion along said longitudinal axis with respect to said first arm portion between said released extended and released retracted positions thereof includes extending or retracting said second arm portion with respect to said first arm portion while said protruding portion is aligned wit said groove such that said protruding portion rides within said groove;

wherein said protruding portion of said first arm portion includes a jack tool coupling portion with a plurality of flat surfaces defining a jack tool receiving opening which allows said tool to couple with an end of a jack tool and rotate about a jack tool axis to effect turning of said jack tool to operate a vehicle jack, such tat two hand placement locations for tinning may be used when said second arm portion is in said interlocked longitudinally extended position with respect to said first arm portion; said method further comprising:

coupling said jack tool coupling structure with the end of the jack tool, and rotating said jack tool coupling structure about a jack tool axis to effect turning of said jack tool to operate a vehicle jack.

16. The method of claim 15 wherein said groove extends beyond one of said wide diameter portions to an end of said second arm portion, allowing said second arm portion to further extend or retract longitudinally from either said released longitudinally extended or said longitudinally retracted position to be separated from said first arm portion; said method further comprising:

extending or retracting said second arm portion longitudinally from either said released longitudinally extended or said longitudinally retracted position to separate said second arm portion from said first arm portion.

17. A method for applying torque to turnable fasteners for fastening or removing a wheel on a motor vehicle, said method comprising:

providing a tool having a first arm portion with a fastener coupling structure constructed and arranged to be removably coupled with a turnable fastener, said first arm portion extending on a longitudinal axis in a transverse direction wit respect to a turning axis through a center of said turnable fastener, said tool also having a second arm portion mounted to said first aim portion for longitudinal relative movement with respect to said first arm portion, said first arm portion and said second arm portion include cooperating structure constructed and disposed to (1) allow said second arm portion to be rotated about said longitudinal axis with respect to said first arm portion between an interlocked longitudinally extended position and a released longitudinally extended position, (2) allow said second arm portion to be extended or retracted generally longitudinally with respect to said first arm portion between said released longitudinally extended position and a longitudinally retracted position, and (3) prevent said second arm portion from retracting generally longitudinally when said second arm portion is in said interlocked longitudinally extended position;

removing said tool from a storage location within said motor vehicle, said second arm portion being in said longitudinally retracted position with respect to said first arm portion so that said tool is of a length suitable for storage in said storage location;

extending said second arm portion generally longitudinally with respect to said first arm portion from said longitudinally retracted position to said released longitudinally extended position;

rotating said second mm portion about said longitudinal axis with respect to said first arm portion to said interlocked longitudinally extended position so as to enable said cooperating structure to prevent said second arm portion from retracting generally longitudinally;

coupling said fastener coupling structure to said turnable fastener;

manually applying a force generally circumferential to said turning axis to said second arm portion in longitudinally spaced relation to said turning axis to apply via said first arm portion a torque to affect turning of said tunable fastener;

repeating the previous step on a plurality of fasteners until said wheel is fully fastened to said motor vehicle or fully removed from said motor vehicle;

rotating said second arm portion about said longitudinal axis with respect to said first arm portion thereby returning said second arm portion to said released longitudinally extended position so as to enable said cooperating structure to allow said second arm portion to retract generally longitudinally;

retracting said second arm portion generally longitudinally with respect to said first arm portion thereby returning said second arm portion to said longitudinally retracted position so that said tool is again of said length suitable for storage in said storage location;

and returning said tool to said storage location within said motor vehicle;

wherein one of said first and second arm portions is received within the other of said first and second arm portions, said cooperating structure comprises a protruding portion on said one of said first and second arm portions in cooperation with two wide diameter portions connected to a groove on an inner surface of the other of said first and second arm portions such that said protruding portion may be rotated about said longitudinal axis within said wide diameter portions and may be moved longitudinally within said groove, the other of said first and second arm portions includes a pair of arcuate walls integrally formed with said groove, said arcuate walls having free ends spaced apart from one another to define a gap therebetween parallel to and opposite of said groove, and wherein said protruding portion has a greater width and lesser thickness than the remainder of said one of said first and second arm portions, wherein rotating said second arm portion about said longitudinal axis wit respect to said first arm portion between said released and interlocked longitudinally extended positions includes rotating said second arm portion with respect to said first arm portion when said protruding portion is within an associated one of said wide diameter portions to (a) align said protruding portion with both said groove and said gap to affect said released longitudinally extended position and (b) disalign said protruding portion with said groove and said gap to affect said interlocked longitudinally extended position; and wherein extending or retracting said second am portion along said longitudinal axis with respect to said first arm portion between said released longitudinally extended and longitudinally retracted positions thereof includes extending or retracting said second arm portion with respect to said first arm portion while said protruding portion is aligned with both said groove and said gap such that said protruding portion rides within said groove and said gap.

18. The method of claim 17 wherein said groove extends beyond one of said wide diameter portions to an end of said second arm portion, allowing said second arm portion to further extend or retract longitudinally from either said released longitudinally extended or said longitudinally retracted position to be separated from said first arm portion; said method further comprising:

extending or retracting said second arm portion longitudinally from either said released longitudinally extended or said longitudinally retracted position to separate said second arm portion from said first arm portion.

* * * * *